US005824928A

United States Patent [19]

Kumano et al.

[11] Patent Number: 5,824,928

[45] Date of Patent: Oct. 20, 1998

[54] KEYBOARD APPARATUS FOR MUSICAL INSTRUMENT

[75] Inventors: Shinji Kumano; Tsuyoshi Sato, both of Hamamatsu, Japan

[73] Assignee: Yamaha Corporation, Japan

[21] Appl. No.: 816,172

[22] Filed: Mar. 12, 1997

[30] Foreign Application Priority Data

Mar. 12, 1996 [JP] Japan ..... 8-055175

[51] Int. Cl.[6] ..... G10C 3/12

[52] U.S. Cl. ..... 84/423 R; 84/440; 84/745

[58] Field of Search ..... 84/423 R, 430, 84/432, 438, 452 R, 452 P, 440

[56] References Cited

U.S. PATENT DOCUMENTS 4,885,969 12/1989 Chesters ..... 84/615

4,901,614 2/1990 Kumano et al. ..... 84/719

*Primary Examiner*—William M. Shoop, Jr.

*Assistant Examiner*—Shih-Yung Hsieh

*Attorney, Agent, or Firm*—Rossi & Associates

[57] ABSTRACT

A keyboard apparatus for a musical instrument which includes a laterally elongated frame structure made of synthetic resin, a plurality of keys arranged in parallel on the frame structure and pivoted at their proximal ends on a rear end portion of the frame structure to be depressed at their front portions, and a laterally elongated printed circuit board mounted on the frame structure and provided thereon with a plurality of detection switches which are arranged to detect depression of the keys. In the keyboard apparatus, the frame structure is composed of a plurality of laterally spaced vertical reinforcement ribs placed in a fore-and-aft direction of the frame structure, an upper support plate integrally formed with the vertical reinforcement ribs at their upper end surfaces and extended in a lateral direction of the frame structure to be placed under the keys, a key mounting portion integrally formed on a rear end of the upper support plate to support the keys pivoted thereon, and a bottom plate integrally formed with the vertical reinforcement ribs at their front bottom surfaces to support the printed circuit board mounted thereon.

11 Claims, 11 Drawing Sheets

KEYBOARD APPARATUS FOR MUSICAL INSTRUMENT

A BACKGROUND OF THE INVENTION

1. Field of the Invention

The present invention relates to a keyboard apparatus for a musical instrument such as an electronic piano, an electronic organ or the like.

2. Description of the Prior Art

Disclosed in U.S. Pat. No. 4,901,614 granted to Kumano et al. and issued on Feb. 20, 1997 is a keyboard apparatus for an electronic musical instrument which includes a metallic frame structure horizontally placed in position, a plurality of keys each of which is pivoted on a rear end portion of the frame structure at its proximal end to be movable in a vertical direction when depressed, a plurality of swing levers each of which is located under the respective keys and pivoted on the frame structure at a position spaced forward from each proximal end of the keys to be swingable in a vertical direction, the swing levers each being spring loaded to bias the keys rearward and engaged with the keys to apply a reaction force thereto when the keys are depressed. In the keyboard apparatus, a printed circuit board provided thereon with a plurality of detection switches is assembled with the frame structure, and the keys each are provided at their bottom faces with a switch drive portion which is opposed to the respective detection switches on the printed circuit board to be brought into engagement therewith when the keys are depressed.

In such a conventional keyboard apparatus, it is desired to provide a frame structure made of synthetic resin for reducing the manufacturing cost of the keyboard apparatus. However, in the case that the conventional frame structure is made of synthetic resin, the strength of the frame structure becomes insufficient for support of the keys without causing any vertical deformation thereof in their fore-and-aft directions.

SUMMARY OF THE INVENTION

It is, therefore, a primary object of the present invention to provide a keyboard apparatus the frame structure of which is made of synthetic resin and formed to have sufficient strength for support of a plurality of keys mounted thereon without causing any vertical deformation thereof in their fore-and-aft directions.

According to the present invention, the object is accomplished by providing a keyboard apparatus which includes a laterally elongated frame structure made of synthetic resin, a plurality of keys arranged in parallel on the frame structure and pivoted at their proximal ends on a rear end portion of the frame structure to be depressed at their front portions, and a laterally elongated printed circuit board mounted on the frame structure and provided thereon with a plurality of detection switches which are arranged to detect depression of the keys, wherein the frame structure comprises a plurality of laterally spaced vertical reinforcement ribs which are placed in a fore-and-aft direction of the frame structure, an upper support plate integrally formed with the vertical reinforcement ribs at their upper end surfaces and extended in a lateral direction of the frame structure to be placed under the keys, a key mounting portion integrally formed on a rear end of the upper support plate to support the keys pivoted thereon, and a bottom plate integrally formed with the vertical reinforcement ribs at their front bottom surfaces and placed along a front end portion of the frame structure to support the printed circuit board mounted thereon.

According to an aspect of the present invention, there is provided a keyboard apparatus which includes a laterally elongated frame structure made of synthetic resin, a plurality of keys arranged in parallel on the frame structure and pivoted at their proximal ends on a rear end portion of the frame structure to be depressed at their front portions, and a plurality of laterally spaced swing levers pivoted on the frame structure at a position spaced forward from the rear end of the frame structure and engaged with the keys to apply a reaction force thereto when the keys are depressed, wherein the frame structure comprises a plurality of laterally spaced vertical reinforcement ribs placed in a fore-and-aft direction of the frame structure, an upper support plate integrally formed with the vertical reinforcement ribs at their upper end surfaces and extended in a lateral direction of the frame structure to be placed under the keys, a key mounting portion integrally formed on a rear end of the upper support plate to support the keys pivoted thereon at their proximal ends, and a bottom plate integrally formed with the vertical reinforcement ribs at their front bottom surfaces and placed along a front end portion of the frame structure to support the swing levers pivoted thereon, and wherein a center in width of either one of the swing levers is laterally shifted in relation to a center in width of a rear portion of the corresponding key so that either one of the vertical reinforcement ribs is disposed in a space between the shifted swing lever and another one of the swing levers adjacent thereto.

BRIEF DESCRIPTION OF THE DRAWINGS

Other objects, features and advantages of the present invention will be more readily appreciated from the following detailed description of a preferred embodiment thereof when taken together with reference to the accompanying drawings, in which.

DESCRIPTION OF THE PREFERRED EMBODIMENT

Figure 1:
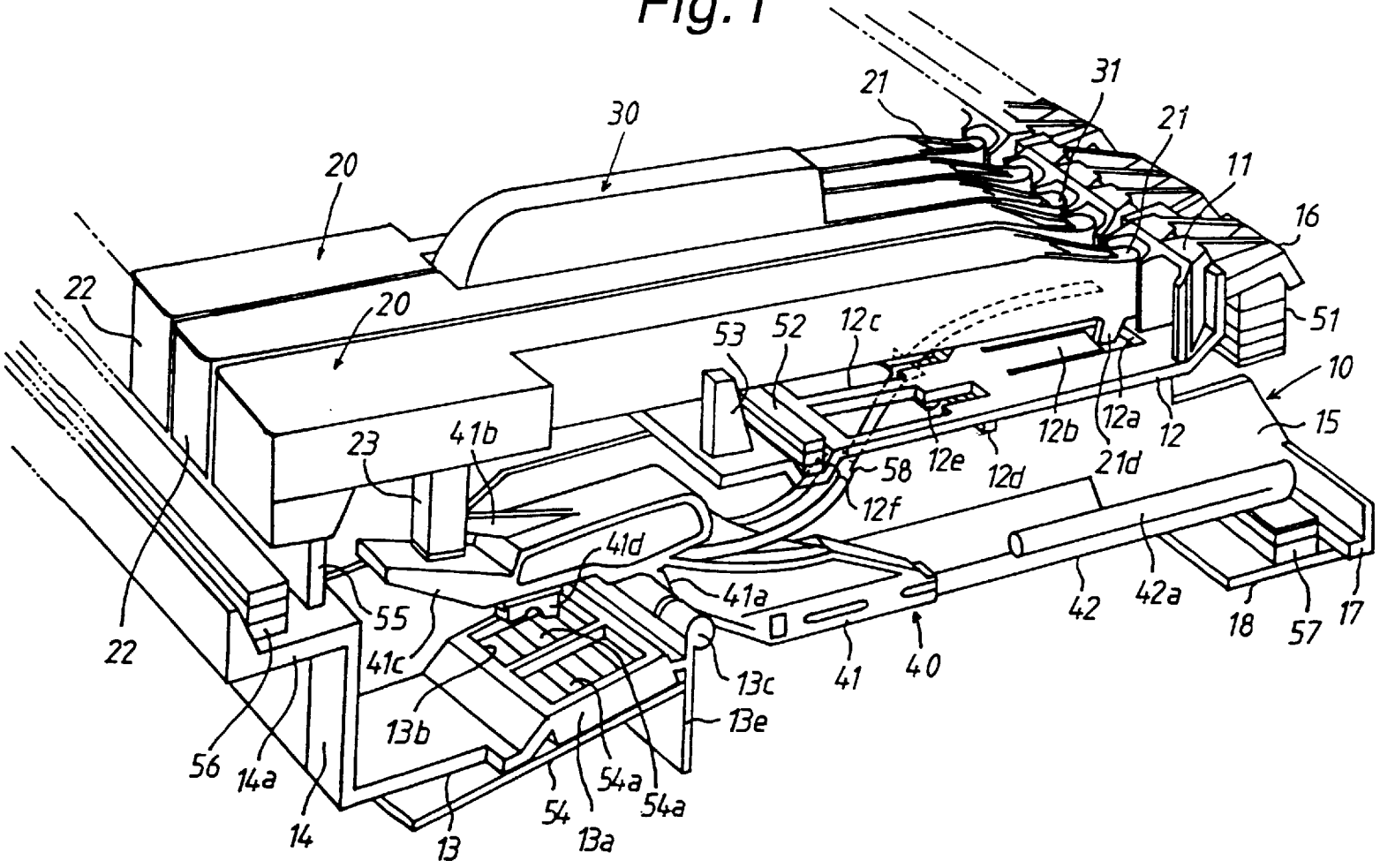
FIG. 1, is a perspective view of a keyboard apparatus in accordance with the present invention.
Figure 2:
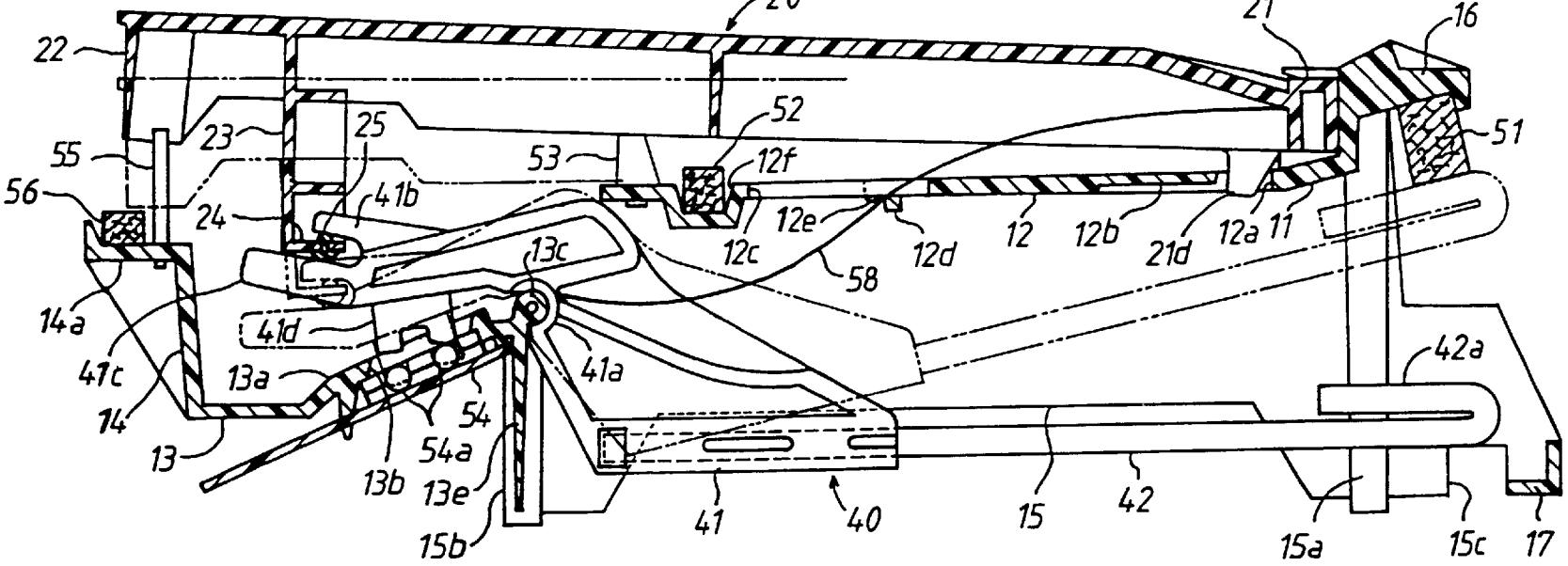
FIG. 2 is a sectional view of the keyboard apparatus taken at a portion of a white key shown in FIG. 1.
Figure 3:
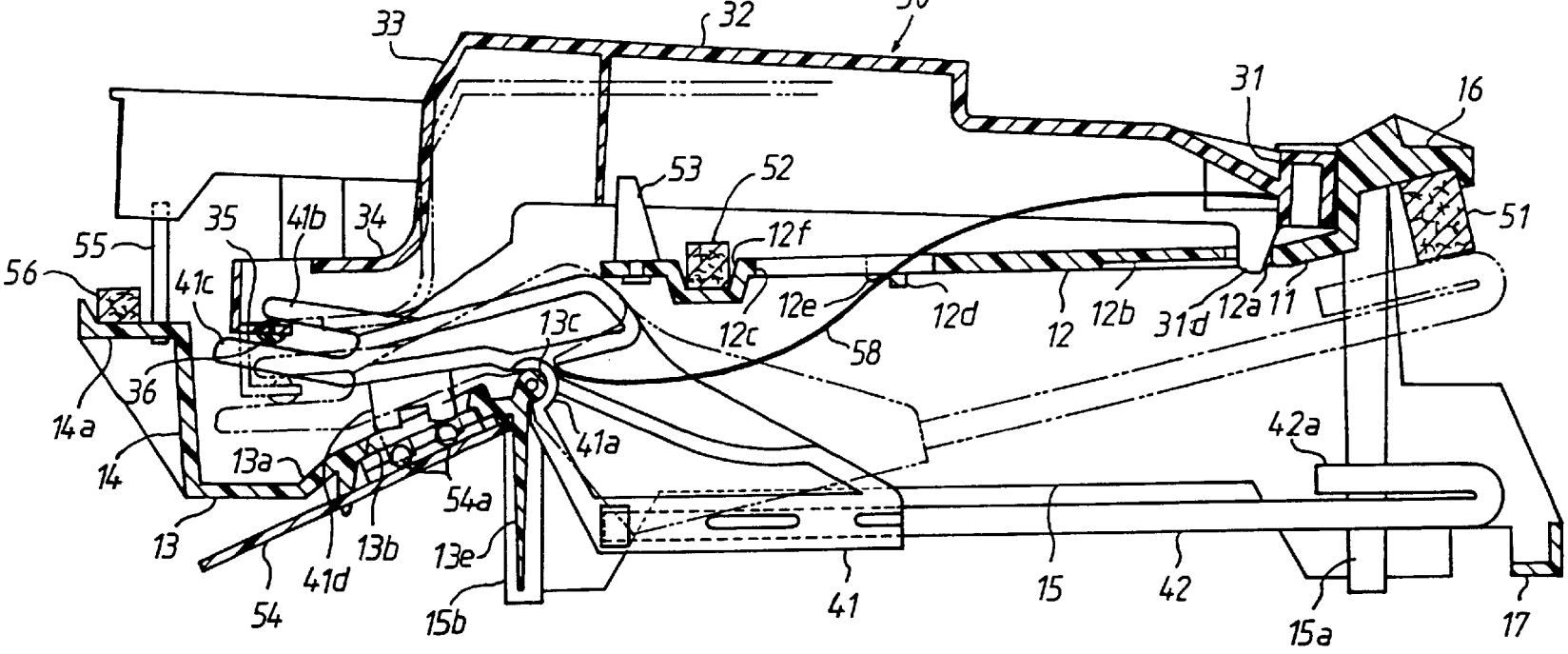
FIG. 3 is a sectional view of the keyboard apparatus taken at a portion of a black key shown in FIG. 1.
Figure 4:
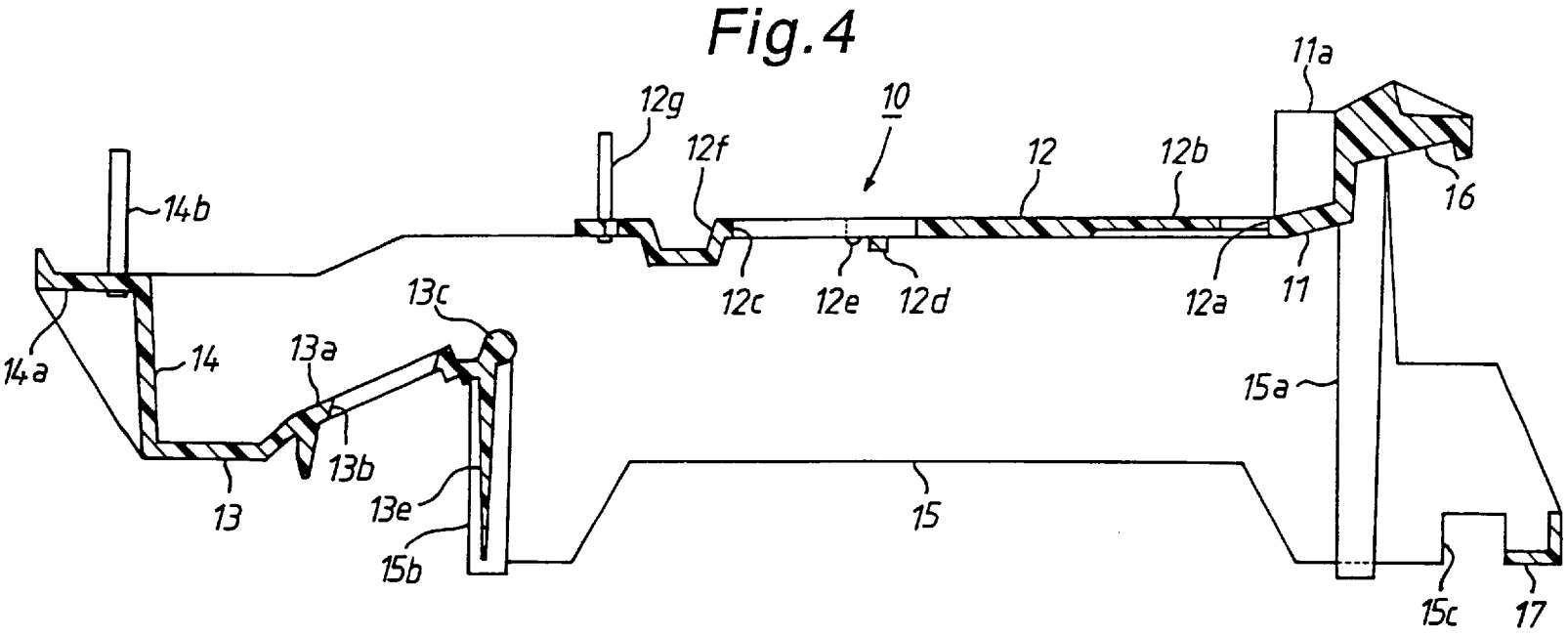
FIG. 4 is a sectional view of a frame structure in a fore-and-aft direction shown in FIG. 1.
Figure 5:
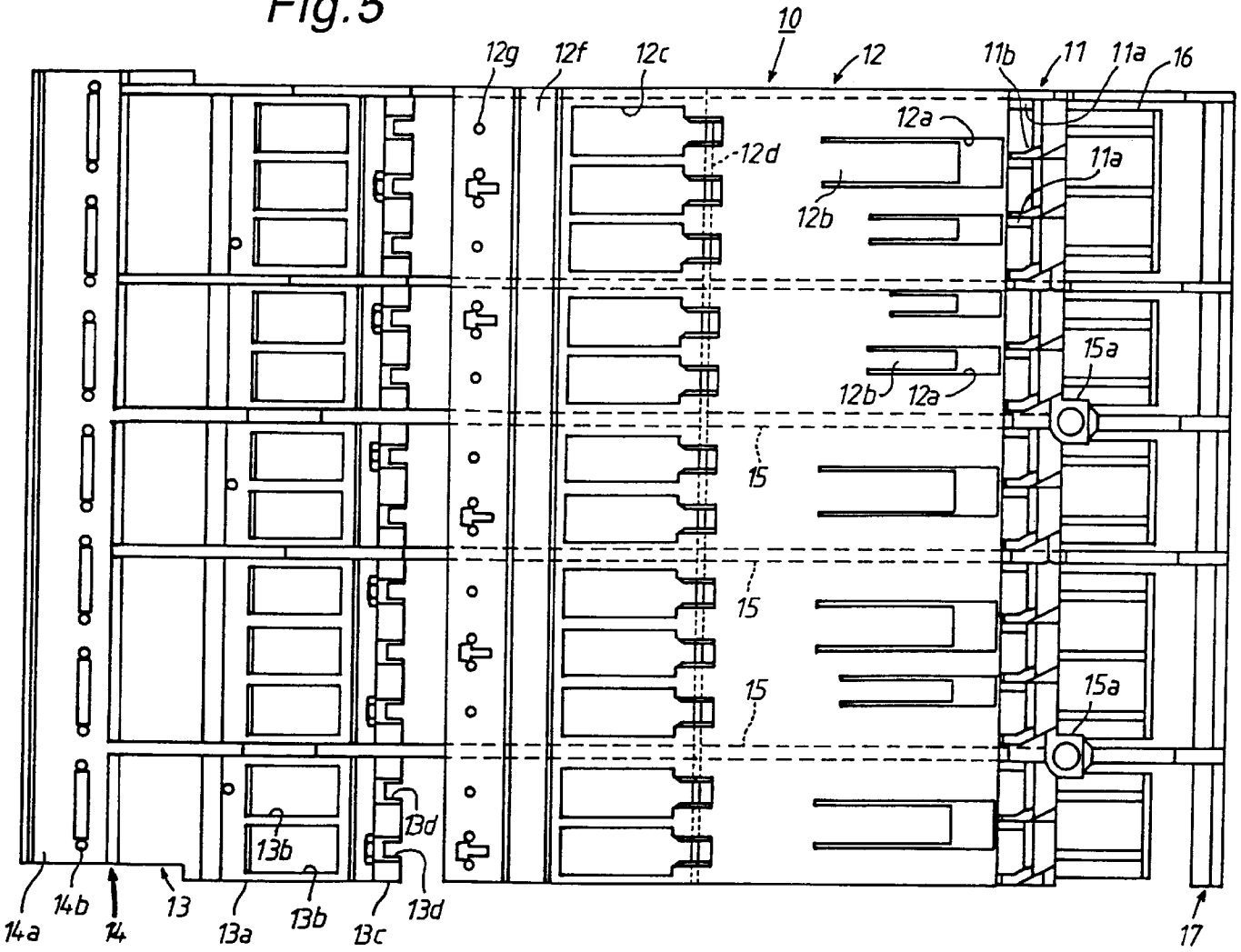
FIG. 5 is a plan view of the frame structure shown in FIG. 4.
Figure 8:
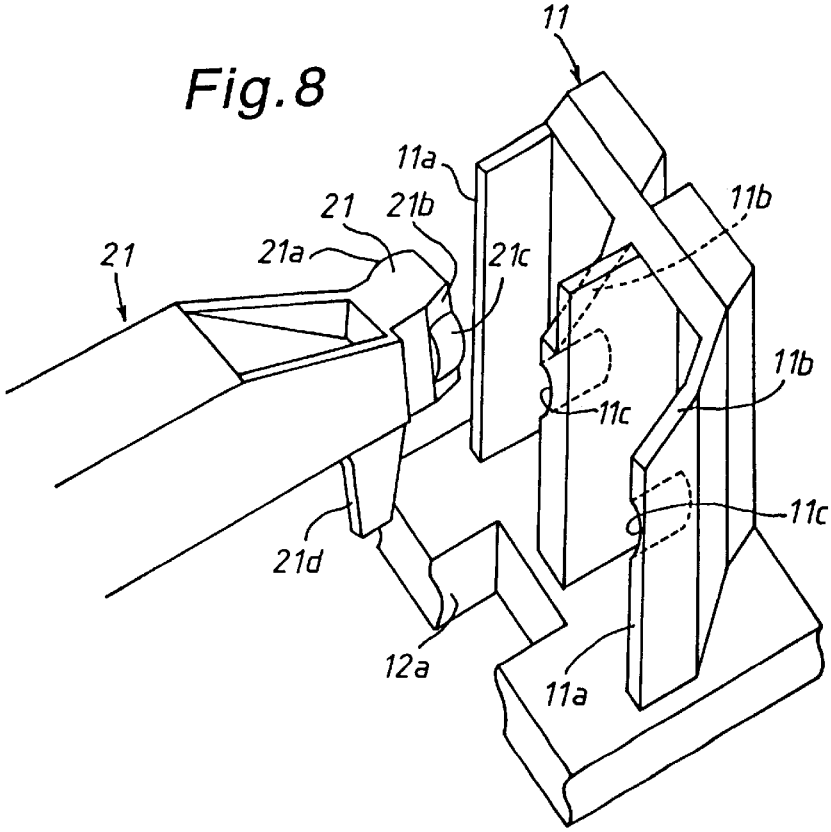
FIG. 8 is an enlarged perspective view of a key mounting portion of the frame structure shown in FIG. 1.
Figure 9:
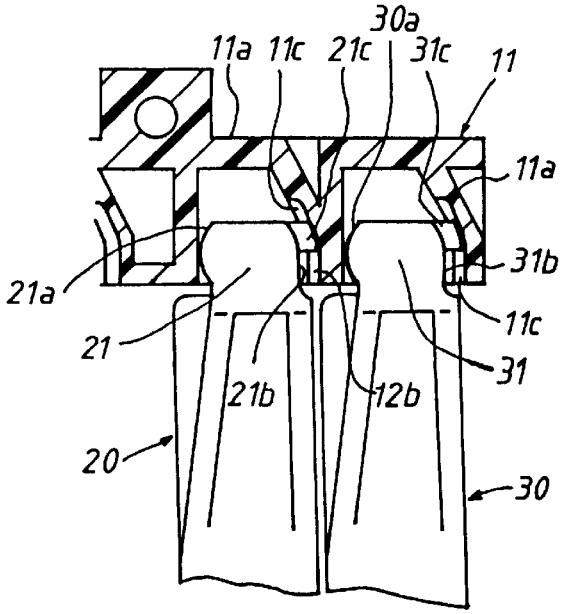
FIG. 9 is an enlarged transverse sectional view of the key mounting portion of the frame structure shown in FIG. 8.

Illustrated in FIG. 1 is a keyboard apparatus in accordance with the present invention which includes a plurality of white and black keys 20 and 30 arranged in parallel on a frame structure 10 and a plurality of swing levers 40 mounted on the frame structure at each position located under the respective keys 20 and 30. As shown in FIGS. 1 to 5, the frame structure 10 has a plurality of laterally spaced vertical reinforcement ribs 15 integrally formed with an upper support plate 12, a bottom plate 13 and a front plate 14. The upper support plate 12 is integrally formed at its read end with a key mounting portion 11 extending in a lateral direction of the frame structure 10. As shown in FIGS. 8 and 9, the key mounting portion 11 is formed with a plurality of laterally spaced vertical side walls 11*a* forming a plurality of laterally spaced vertical channels for engagement with each proximal end of the keys 20 and 30. The vertical side walls 11*a* each are formed with a downwardly inclined guide surface 11*b* and a semi-cylindrical transverse recess 11*c*. As shown in FIGS. 4 and 5, a plurality of laterally spaced support portions 16 are integrally formed with the rear end face of key mounting portion 11, and an elongated upper stopper 51 of layered felts is adhered to bottom surfaces of the support portions 16 along the key mounting portion 11.

As shown in FIG. 4, the upper support plate 12 is horizontally extended forward from the bottom of key mounting portion 11. As shown in FIG. 5, the upper support plate 12 is formed with a plurality of laterally spaced rectangular holes 12*a* located adjacent the side walls 11*a* of key mounting portion 11 at their rear ends and is formed with a plurality of resilient strips 12*b* extended rearward therefrom in each rectangular hole 12*a*. The rectangular holes 12*a* are in the form of two kinds of rectangular holes one of which is large in width and the other of which is small in width. The upper support plate 12 is further formed at its intermediate portion with a plurality of laterally spaced elongated holes 12*c* which are formed small in width at their rear end portions. The upper support plate 12 is integrally formed at its bottom face with a lateral bar 12*d* extending across each rear end portion of the elongated holes 12*c* and is formed with plural pairs of opposed projections 12*e* at opposite sides of each rear end portion of the elongated holes 12*c*.

The upper support plate 12 is formed with a lateral channel 12*f* located at the front side of the elongated holes 12*c*. As shown in FIG. 1, an elongated stopper 52 of layered felts is adhered to the bottom of lateral channel 12*f* to restrict downward movement of the black keys 30 when the keys 30 are depressed by an excessive load applied thereto. At the front side of lateral channel 12*f*, a plurality of laterally spaced vertical pins 12*g* are fixedly mounted on the upper support plate 12 as shown in FIGS. 4 and 5, and a guide piece 53 for the black key 30 is coupled with the respective vertical pins 12*g* as shown in FIG. 3.

The bottom plate 13 is extended longitudinally in a lateral direction of the keyboard apparatus at the front end portion of the frame structure 10 and is extended rearwardly upward to form an inclined support portion 13*a*. As shown in FIG. 5, the inclined support portion 13*a* of bottom plate 13 is formed with a plurality of laterally spaced rectangular openings 13*b* which are located to correspond with the white and black keys 20 and 30. A laterally elongated printed circuit board 54 is fixed to the bottom surface of the inclined support portion 13*a*. A plurality of detection switches 54*a* are mounted on the printed circuit board 54 and disposed within the respective openings 13*b* of the inclined support portion 13*a* of bottom plate 13 to detect depression of the white and black keys 20 and 30 by engagement therewith. The inclined support portion 13*a* of bottom plate 13 is integrally formed at its rear end with a plurality of laterally spaced columnar pivot portions 13*c* which are aligned in the lateral direction of the frame structure 10 to support the swing levers 40 pivoted thereon. The columnar pivot portions 13*c* each are formed with a pair of laterally spaced annular grooves 13*d* for engagement with the swing levers 40 and are supported by a plurality of laterally spaced vertical support plates 13*e* integrally formed therewith.

The front plate 14 is extended upward from the front end of bottom plate 13 and is extended forward at its upper end to form a horizontal portion 14*a*. A plurality of laterally spaced vertical pins 14*b* are fixedly mounted on the horizontal portion 14*a*. A guide piece 55 for the respective white keys 20 is coupled with each pair of vertical pins 14*b*. An elongated stopper 56 of layered felts is adhered to the horizontal portion 14*a* of front plate 14 to restrict downward movement of the white key 20 when the key 20 is depressed by an excessive load applied thereto.

As shown in FIG. 5, the vertical reinforcement ribs 15 are spaced in the lateral direction of the frame structure 10 and placed in the fore-and-aft direction of the frame structure 10. As shown in FIG. 4, the vertical reinforcement ribs 15 are Integrally formed at their rear upper faces with the key mounting portion 11 and the upper support plate 12 and at their front bottom faces with the bottom plate 13 and front plate 14. The vertical reinforcement ribs 15 each are integrally formed with a plurality of laterally spaced cylindrical legs 15*a* located under the key mounting portion 11 and a plurality of cylindrical legs 15*b* located between the vertical support plates 13*e*. The cylindrical legs 15*a* and 15*b* are fixed to a key bed (not shown) by means of screws passing therethrough to position the frame structure 10 in place. The vertical reinforcement ribs 15 are tapered downward in thickness to facilitate removal of the frame structure 10 from a molding die. As shown in FIGS. 1 and 2, a horizontal support plate 18 is adhered to the bottom surface of a lateral support beam 17 integrally formed with the rear ends of vertical reinforcement ribs 15. An elongated stopper 57 of layered felts is adhered to the upper surface of support plate 18 and coupled with rectangular recesses 15*c* of vertical reinforcement ribs 15 shown in FIG. 4.

Figure 6A:
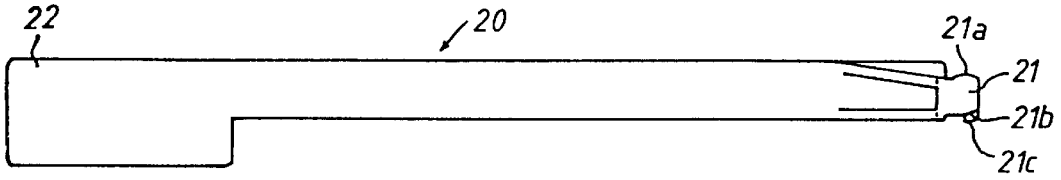
FIG. 6(A) is a plan view of a white key assembled with the keyboard apparatus shown in FIG. 1.
Figure 6B:
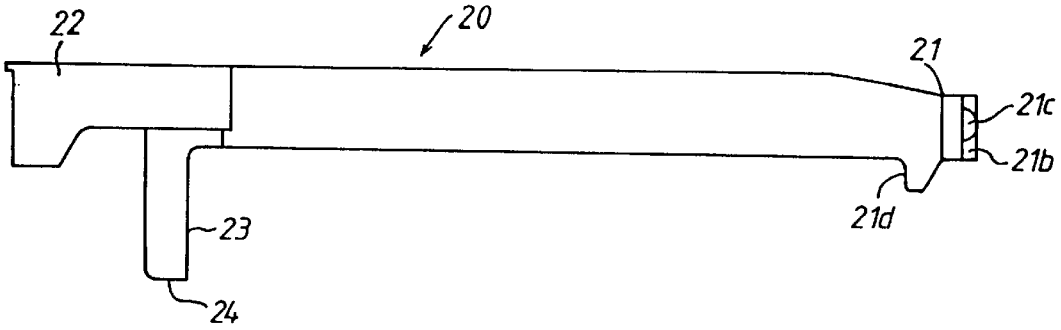
FIG. 6(B) is a side view of the white key shown in FIG. 6(A)
Figure 6C:
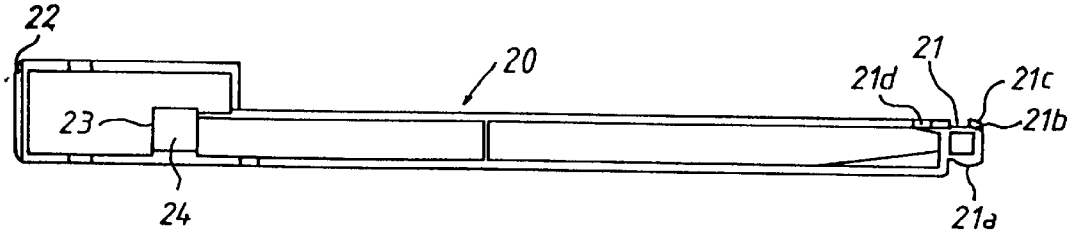
FIG. 6(C) is a bottom view of the white key shown in FIG. 6(A)
Figure 7A:
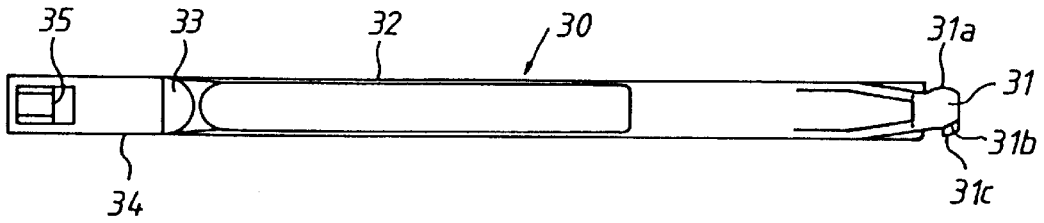
FIG. 7(A) is a plan view of a black key assembled with the keyboard apparatus shown in FIG. 1.
Figure 7B:
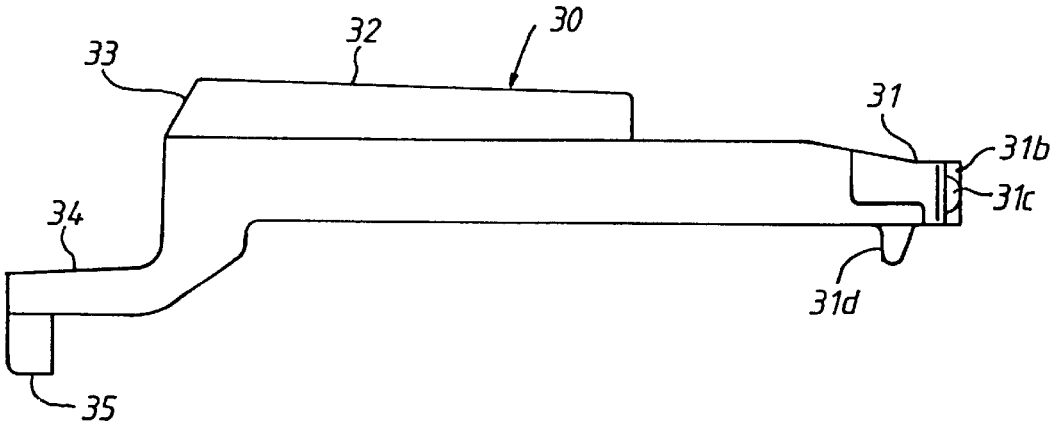
FIG. 7(B) is a side view of the black key shown in FIG. 7(A)

As shown in FIGS. 6(A)–6(C) and 7(A), 7(B), the white and black keys 20 and 30 each are made of synthetic resin and hollowed in a channel shape. The white and black keys 20 and 30 each are pivotally coupled with the vertical side walls 11*a* of key mounting portion 11 at their proximal ends 21, 31 to be movable in a vertical direction and are loaded rearward respectively by means of a leaf spring 58. As shown in FIGS. 8 and 9, each proximal end 21 of the white keys 20 is formed at one side thereof with a vertical semi-columnar portion 21*a* and at the other side thereof with a pair of vertically spaced flat surfaces 21*b* tapered rearward and a semi-spherical protrusion 21*c*. Similarly, as shown in FIGS. 7(A) and 7(B), each proximal end 31 of the black keys 30 is formed at one side thereof with a vertical semi-columnar portion 31*a* and at the other side thereof with a pair of vertically spaced flat surfaces 31*b* tapered rearward and a semi-spherical protrusion 31*c*. The white and black keys 20 and 30 are formed at their proximal ends 21, 31 thereof with downward projections 21*d*, 31*d* respectively, each of which is inserted into the respective rectangular holes 12*a* of upper support plate 12.

During an assembly process of the keyboard apparatus, the proximal ends 21, 31 of white and black keys 20 and 30 each are pushed into each channel between the vertical side walls 11*a* under the load of each leaf spring 58 during which the semi-spherical protrusions 21*c*, 31*c* of the proximal ends 21, 31 each are guided by sliding engagement with each guide surface 11*b* of vertical side walls 11*a* and placed to correspond with each semi-cylindrical recess 11*c* of vertical side walls 11*a*. As a result, the proximal ends 21, 31 of white and black keys 20 and 30 are coupled within each channel between the vertical side walls 11*a* under the load of leaf spring 58 in a condition where the flat surfaces 21*b*, 31*b* of the proximal ends 21, 31 are slightly spaced from internal surfaces of vertical side walls 11*a* and where the rear surfaces of the proximal ends 21, 31 are spaced from internal surfaces of the key mounting portion 11. Thus, the white and black keys 20 and 30 are pivotally mounted on the frame structure 10 at their proximal ends to be movable in a vertical direction. When the semi-spherical protrusions 21*c*, 31*c* of the proximal ends 21, 31 each are coupled with the corresponding semi-cylindrical recesses 11*c* of vertical side walls 11*a* during the assembly process, the resilient strips 12*b* each are deformed downward by engagement with the vertical projections 21*d*, 31*d* of keys 20, 30 to bias the keys 20, 30 rearward. When the vertical projections 21*d*, 31*d* of keys 20, 30 each are Inserted into the corresponding rectangular holes 12*a*, the resilient strips 12*b* act to retain the keys 20, 30 in position by engagement with the vertical projections 21*d*, 31*d* of keys 20, 30. When it is desired to remove the keys 20, 30 from the frame structure 10, the keys 20, 30 each can be pulled forward and raised in a condition where the rear ends of resilient strips 12*b* have been pushed downward.

Figure 10:
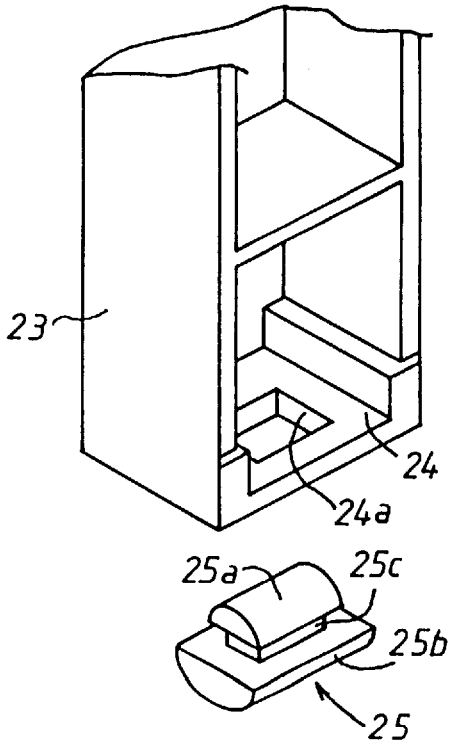
FIG. 10 is an enlarged perspective view of a vertical hammer portion of the white key shown in FIG. 1.
Figure 11:
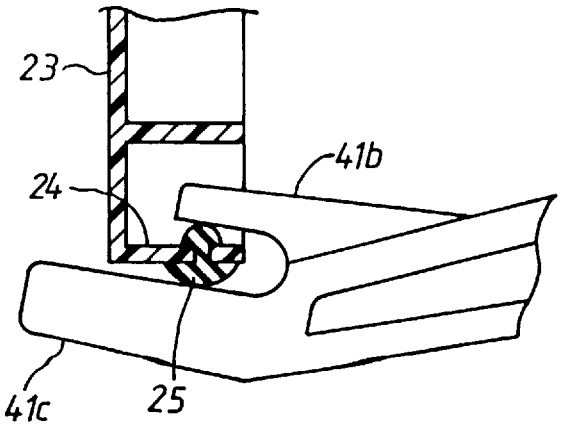
FIG. 11 is an enlarged sectional side view of the vertical hammer portion assembled with a swing lever shown in FIG. 1.

At the front end portion of white key 20, a vertical hammer portion 23 is integrally formed with the bottom face of key 20. As shown in FIGS. 10 and 11, the vertical hammer portion 23 is hollowed and formed with a bottom wall 24. As shown in FIG. 6(C), the vertical hammer portion 23 is formed at a position laterally shifted from a center line in width of key 20 and aligned with the proximal end 21 of key 20. As shown in FIG. 10, an elastic element 25 made of synthetic rubber is fixedly coupled with a rectangular aperture 24*a* of bottom wall 24. The elastic element 25 is formed with a pair of spaced semi-columnar portions 25*a* and 25*b* which are integrally connected to one another by means of a stem portion 25*c*. The elastic element 25 is coupled with the aperture 24*a* at its stem portion 25*c* in such a manner that the semi-columnar portions 25*a* and 25*b* are placed in the lateral direction of the frame structure 10. The semi-columnar portions 25*a* and 25*b* are coated with lubricant, and the stem portion 25*c* is adhered to the bottom wall 24.

As shown in FIGS. 7(A) and 7(B), the black key 30 is integrally formed at its front end portion 33 with a hammer portion 34 shaped in an approximately L-letter. The hammer portion 34 is hollowed and formed with a bottom wall 35. As shown in FIG. 3, an elastic element 36 is fixedly coupled with the bottom wall 35 of hammer portion 34 in the same manner as in the white key 20. The center in width of hammer portion 34 is aligned with the center in width of key 30 and the proximal end 31 of key 30.

As shown in FIGS. 1 to 3 and 12(A), 12(B), the swing lever 40 is composed of a body member 41 made of synthetic resin and an elongated metallic weight member 42. The body member 41 is In the form of a flat plate which is vertically placed in the fore-and-aft direction and located under the front end portion of key 20 or 30. The body member 41 of swing lever 40 is formed at its bottom central portion with a cylindrical recess 41*a* the axis line of which is aligned in the lateral direction of the keyboard apparatus. The cylindrical recess 41*a* is opened forwardly downward and coupled with the pivot portion 31*c* formed on the upper end of the vertical support plate 13*e*. As shown in FIG. 5, the pivot portion 13*c* is formed with the annular groove 13*d* which is engaged with a small projection 41*a* 1 formed on an internal wall of cylindrical recess 41*a* to restrict lateral movement of the body member 41.

Figure 13:
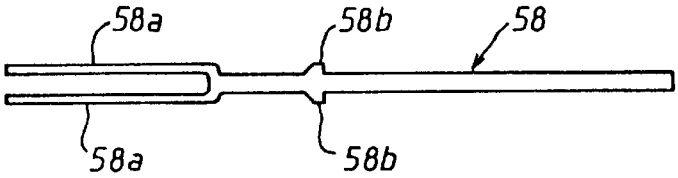
FIG. 13 is a plan view of an elongated leaf spring shown in FIG. 1.

As shown in FIGS. 2 and 3, the swing lever 40 is loaded forward by means of the elongated leaf spring 58 engaged at its rear end with the proximal end 21 or 31 of key 20 or 30. As shown in FIG. 13, the leaf spring 58 has a front end portion in the form of a pair of bifurcated parallel legs 58*a*, 58*a* and is formed at its central portion with a pair of projections 58*b*, 58*b*. The legs 58*a*, 58*a* of leaf spring 58 are extended forward at opposite sides of an upper thin portion of body member 41 and engaged at their front ends with an outer peripheral thick portion of the cylindrical recess 41*a*. The rear portion of leaf spring 58 is extended upwardly through the rectangular hole 12*c* of upper support plate 12 and engaged at its rear end with an internal wall of the proximal end 21 or 31 of key 20 or 30 in such a manner that the projections 58*b*, 58*b* of leaf spring 58 are engaged with the lateral bar 12*d* at their rear ends and engaged with the opposed projections 12*e* at their upper surfaces. Thus, the leaf spring 58 is assembled in a condition deformed in an S-letter configuration by engagement with the proximal end of key 20 or 30 and the outer peripheral thick portion of the cylindrical recess 41*a* at its opposite ends and is carried by the lateral bar 12*d* and opposed projections 12*e* at its central portion. In such an arrangement of the leaf spring 58, the lateral bar 12*d* acts to restrict downward movement of the leaf spring 58, while the opposed projections 12*e* act to restrict upward movement of the leaf spring 58.

Figure 12A:
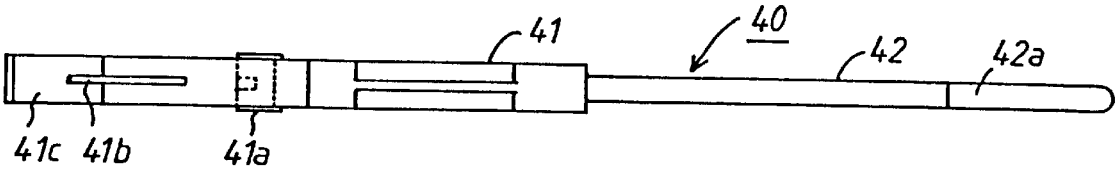
FIG. 12(A) is a plan view of a swing lever shown in FIG. 1.
Figure 12B:
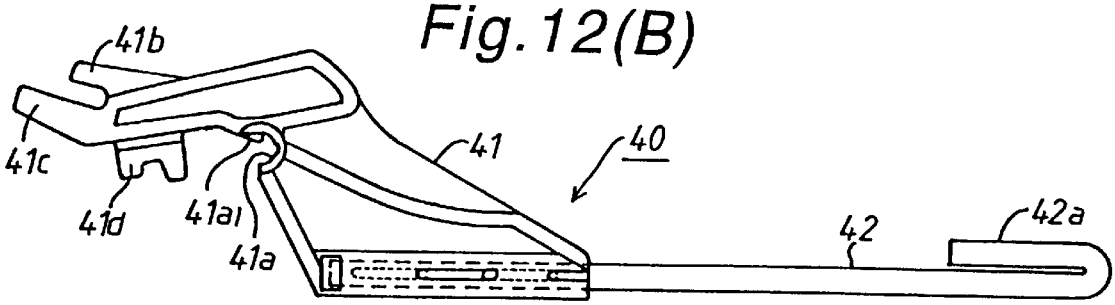
FIG. 12(B) is a side view of the swing lever shown in FIG. 12(A)

The body member 41 of swing lever 40 is formed at the front end thereof with a pair of vertically bifurcated legs 41*b* and 41*c*. The upper leg 41*b* is formed smaller in length than the lower leg 41*c*. The hammer portion 23 or 34 of key 20 or 30 is engaged at its bottom wall 24 or 35 with the pair of legs 41*b* and 41*c* of body member 41 through the elastic element 25 or 36 in such a manner as to permit sliding movement of the elastic element 25 or 36 relative to the legs 41*b* and 41*c*. As shown in FIG. 12(B), the body member 41 of swing lever 40 is formed at its bottom face with a switch drive portion 41*d* which is located between the leg 41*c* and cylindrical recess 41*a*. As shown in FIGS. 1 and 2, the switch drive portion 41*d* is opposed to a pair of switches 54*a* through the openings 13*b* of bottom plate 13. The pair of switches 54*a* are mounted in parallel on the printed circuit board 54. The switch drive portion 41*d* of body member 41 is formed with a pair of projections which are brought into engagement with the switches 54*a* in a direction perpendicular to the printed circuit board 54 when the key 20 or 30 is depressed.

The elongated weight member 42 is in the form of a metallic rod the front end of which is connected to the body member 41 of swing lever 40 by outsert forming of body member 41. The metallic rod 42 acts to apply a reaction force to the key 20 or 30 when the key is depressed and acts to restrict upward movement of the front end of the key by engagement with the lower stopper 57 and to restrict downward movement of the front end of the key by engagement with the upper stopper 51. The metallic rod 42 is folded at an appropriate position to adjust the load acting on the key 20 or 30. In the keyboard apparatus, the weight of metallic rod 42 is adjusted to apply the same load to the white and black keys 20 and 30 located adjacent to one another. In addition, the loads acting on the higher note keys are determined smaller than the loads acting on the lower note keys.

Figure 14:
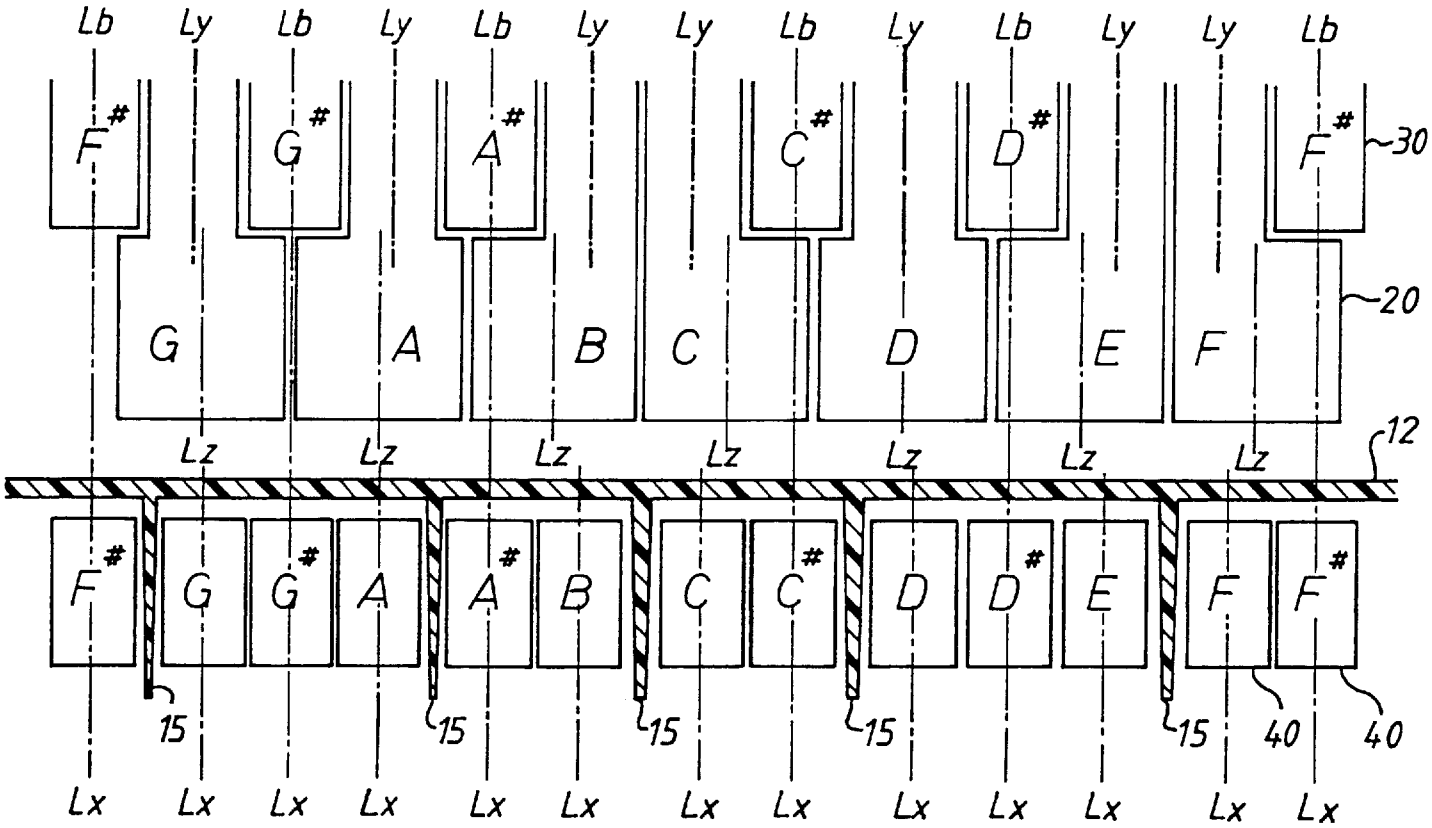
FIG. 14 illustrates an arrangement of swing levers and vertical reinforcement ribs in relation to white and black keys in the keyboard apparatus shown in FIG. 1.

In FIG. 14, there is schematically illustrated the arrangement of the white and black keys 20 and 30 in relation to the vertical reinforcement ribs 15 and the swing levers 40. In the figure, center lines Lx, Ly, Lz and Lb represent each center in width of the swing levers 40, the rear portions of white keys 20 located adjacent the black keys 30, the front portions of white keys 20 and the black keys 30. The center line Lx in width of each swing lever 40 is aligned with the center In width of the hammer portion 23 of white key 20 or the hammer portion 24 of black key 30. The front portion of white key 20 is larger in width than the black key 30, and the black key 30 is slightly larger in width than the swing lever 40. In the keyboard apparatus, it is desirable that the swing lever 40 is enlarged in width to be moved on the pivot portion 13*c* without causing any lateral twist movement thereof.

In the keyboard apparatus, each center in width of the swing levers 40 for C#, D#, F#, G#, A# is aligned with each center Lb in width of all the corresponding black keys 30. Each center Lx in width of the swing levers 40 for "B" and "C" notes is laterally shifted toward each center Lz in width of the front portions of the corresponding white keys 20 in relation to each center Ly in width of the rear portions of the white keys so that the vertical reinforcement rib 15 is disposed in a space between the swing levers 40 for "B" and "C" notes. Such an arrangement of the swing levers 40 is useful to restrain lateral twist movement of the white keys 20 In depression. Similarly, each center Lx in width of the swing levers 40 for "E" and "F" notes is laterally shifted toward each center Lz in width of the front portions of the corresponding white keys 20 in relation to each center Ly in width of the rear portions of the white keys so that the vertical reinforcement rib 15 is disposed in a space between the swing levers for "E" and "F" notes. The center Lx in width of the swing lever 40 for a "D" note is laterally shifted toward the swing lever 40 for a "C#" note in relation to the center Ly in width of the rear portion of the corresponding white key 20 so that the vertical reinforcement rib 15 is disposed in a space between the swing levers 40 for "C#" and "D" notes. Alternatively, the center Lx in width of the swing lever 40 for the "D" note may be laterally shifted toward the swing lever for the "C#" note in relation to the center Ly In width of the rear portion of the corresponding white key 20 so that the vertical reinforcement rib 15 is disposed in a space between the swing levers 40 for the "D" note and a "D#" note.

The center Lx in width of the swing lever for a "G" note is laterally shifted toward the swing lever for a "G#" note in relation to the center Ly in width of the rear portion of the corresponding white key 20 so that the vertical reinforcement rib 15 is disposed in a space between the swing levers for a "F#" note and the "G" note. Alternatively, the center Lx in width of the swing lever 40 for the "G" note may be laterally shifted toward the swing lever 40 for the "F#" note in relation to the center Ly in width of the rear portion of the corresponding white key 20 so that the vertical reinforcement rib 15 is disposed in a space formed between the swing levers 40 for the "G" and "G#" notes. The center Lx in width of the swing lever 40 for a "A" note is laterally shifted toward the swing lever 40 for the "G#" note in relation to the center Ly in width of the rear portion of the corresponding white key so that the vertical reinforcement rib 15 is disposed In a space between the swing levers 40 for a "A#" note and the "A" note. Alternatively, the center Lx in width of the swing lever 40 for the "A" note may be laterally shifted toward the swing lever 40 for the "A#" note in relation to the center Ly in width of the rear portion of the corresponding white key 20 so that the vertical reinforcement rib 15 is disposed in a space formed between the swing levers 40 for the "G#" and "A" notes. Since each center Ly in width of the white keys 20 for the "G", "A" and "D" notes at their rear portions is approximately aligned with each center Lz in width thereof at their front portions, the swing levers 40 for the "G", "A" and "D" are laterally shifted only in a slight amount to restrain lateral twist movement of the white keys 20 in depression.

In a released condition of the keys 20 and 30, each weight member 42 of the swing levers 40 is maintained in engagement with the lower stopper 57 by its self-weight to place the keys 20, 30 and swing levers 40 as shown by solid lines in FIGS. 2 and 3. When one of the white keys 20 or black keys 30 is depressed at its front end portion against the load of weight member 42, downward movement of the key is restricted by abutment of the weight member 42 against the upper stopper 51 as shown by Imaginary lines in FIGS. 2 and 3. In this instance, the switches 54*a* on the printed circuit board 54 are depressed by the switch drive portion 41*d* of the key to detect depression of the key. When the key is released, the weight member 42 acts to return the swing lever 40 to the initial position. When depressed, the key is applied with a reaction force caused by inertia moment of the swing lever 40 to provide a key touch feeling similar to that in a traditional piano. If the keys 20 and 30 are depressed by a heavy load applied thereon, the stoppers 56 and 52 act to support the depressed keys to prevent deformation of the keys In the vertical direction.

In the frame structure 10 of the keyboard apparatus, the vertical reinforcement ribs 15 can be formed larger in vertical width at the region between the cylindrical legs 15*a* and 15*b* spaced in the fore-and-aft direction. This is useful to enhance the strength of the upper support plate 12 in the vertical direction to prevent deformation of the frame structure 10 in the vertical direction. The vertical support plates 13*e* formed between the cylindrical legs 15*a* are useful to enhance the strength of the frame structure 10 at the pivot portions 13*c* of swing levers 40. As the front plate 14 is reinforced by the vertical reinforcement ribs 15, the white keys 20 can be prevented from vertical deformation thereof by engagement with the stopper 56 on the horizontal portion 14*a* of front plate 14. Since the swing levers 40 are arranged in such a manner that the plurality of vertical reinforcement ribs 15 are placed in a region for one octave as shown in FIG. 14, the strength of the frame structure 10 along the white and black keys 20 and 30 is enhanced by the vertical reinforcement ribs 15. In addition, the printed circuit board 54 attached to the bottom surface of the rear support portion 13*a* of bottom plate 13 is useful to assemble in a simple manner the detection switches 54*a* thereon.

What is claimed is:

1. A keyboard apparatus including a laterally elongated frame structure made of synthetic resin, a plurality of keys arranged in parallel on said frame structure and pivoted at their proximal ends on a rear end portion of said frame structure to be depressed at their front portions, and a laterally elongated printed circuit board mounted on said frame structure and provided thereon with a plurality of detection switches which are arranged to detect depression of said keys, wherein said frame structure comprises:

a plurality of laterally spaced vertical reinforcement ribs which are placed in a fore-and-aft direction of said frame structure;

an upper support plate integrally formed with said vertical reinforcement ribs at their upper end surfaces and extended in a lateral direction of said frame structure to be placed under said keys;

a key mounting portion integrally formed on a rear end of said upper support plate to support said keys pivoted thereon at their proximal ends; and a bottom plate integrally formed with said vertical reinforcement ribs at their front bottom surfaces and placed along a front end portion of said frame structure to support said printed circuit board mounted thereon.

2. A keyboard apparatus as claimed in claim 1, wherein said frame structure further comprises a front plate integrally formed with a front end of said vertical reinforcement ribs and extended upward from a front end of said bottom plate, and wherein an elongated stopper is mounted on said front plate to restrict downward movement of said keys.

3. A keyboard apparatus as claimed in claim 1, wherein said printed circuit board is mounted on a support portion which is extended rearwardly upward from said bottom plate and located along the front end portion of said frame structure.

4. A keyboard apparatus as claimed in claim 3, wherein a plurality of laterally spaced swing levers are pivoted on a plurality of laterally spaced pivot portions integrally formed with a rear end of said support portion and engaged with said keys to apply a reaction force thereto when said keys are depressed, and wherein said swing levers each are formed at their front bottom surfaces with a switch drive portion to be engaged with said detection switches on said printed circuit board.

5. A keyboard apparatus as claimed in claim 3, wherein a plurality of laterally spaced swing levers are pivoted on a plurality of laterally spaced pivot portions integrally formed with a rear end of said support portion and engaged with said keys to apply a reaction force thereto when said keys are depressed, and wherein a plurality of vertical support plates are integrally formed with the rear end of said support portion between said vertical reinforcement ribs for support of said pivot portions.

6. A keyboard apparatus including a laterally elongated frame structure made of synthetic resin, a plurality of keys arranged in parallel on said frame structure and pivoted at their proximal ends on a rear end portion of said frame structure to be depressed at their front portions, and a plurality of laterally spaced swing levers pivoted on said frame structure at a position spaced forward from the rear end of said frame structure and engaged with said keys to apply a reaction force thereto when said keys are depressed, wherein said frame structure comprises:

a plurality of laterally spaced vertical reinforcement ribs which are placed in a fore-and-aft direction of said frame structure;

an upper support plate integrally formed with said vertical reinforcement ribs at their upper end surfaces and extended in a lateral direction of said frame structure to be placed under said keys;

a key mounting portion integrally formed on a rear end of said upper support plate to support said keys pivoted thereon; and a bottom plate integrally formed with said vertical reinforcement ribs at their front bottom surfaces and placed along a front end portion of said frame structure to support said swing levers pivoted thereon, and wherein a center In width of either one of said swing levers is laterally shifted in relation to a center in width of a rear portion of the corresponding key so that either one of said vertical reinforcement ribs is disposed in a space between said shifted swing lever and another one of said swing levers adjacent thereto.

7. A keyboard apparatus including a laterally elongated frame structure made of synthetic resin, a plurality of white and black keys for twelve scales arranged in parallel on said frame structure and pivoted at their proximal ends on a rear end portion of said frame structure to be depressed at their front portions, and a plurality of laterally spaced swing levers pivoted on said frame structure at a position spaced forward from the rear end of said frame structure and engaged with said keys to apply a reaction force thereto when said keys are depressed, wherein said frame structure comprises:

a plurality of laterally spaced vertical reinforcement ribs which are placed in a fore-and-aft direction of said frame structure;

an upper support plate integrally formed with said vertical reinforcement ribs at their upper end surfaces and extended in a lateral direction of said frame structure to be placed under said keys;

a key mounting portion integrally formed on a rear end of said upper support plate to support said keys pivoted thereon; and a bottom plate integrally formed with said vertical reinforcement ribs at their front bottom surfaces and placed along a front end portion of said frame structure to support said swing levers pivoted thereon, and wherein a center in width of either one of said swing levers is laterally shifted in relation to a center in width of a rear portion of the corresponding white key so that either one of said vertical reinforcement rib is disposed in a space between said shifted swing lever and another one of said swing levers adjacent thereto.

8. A keyboard apparatus as claimed in claim 7, wherein each center in width of said swing levers for "B" and "C" notes is laterally shifted toward each center in width of the front portions of the corresponding white keys in relation to each center in width of the rear portions of said white keys so that one of said vertical reinforcement ribs is disposed in a spaced between said swing levers for the "B" and "C" notes, and wherein each center in width of said swing levers for "E" and "F" notes is laterally shifted toward each center in width of the front portions of the corresponding white keys in relation to each center in width of the rear portions of said white keys so that another one of said vertical reinforcement ribs is disposed in a space between said swing levers for the "E" and "F" notes.

9. A keyboard apparatus as claimed in claim 8, wherein a center in width of said swing lever for a "D" note is laterally shifted toward said swing lever for a "D#" note in relation to a center in width of the rear portion of the corresponding white key so that the other one of said vertical reinforcement ribs is disposed in a space between said swing levers for the "C#" and "D" notes.

10. A keyboard apparatus as claimed in claim 8, wherein a center width of said swing lever for a "A" note is laterally shifted toward said swing lever for a "G#" note in relation to a center in width of the rear portion of the corresponding white key so that one of said vertical reinforcement ribs is disposed in a space between said swing levers for a "A#" note and the "A" note.

11. A keyboard apparatus as claimed in claim 8, wherein a center in width of said swing lever for a "G" note is laterally shifted toward said swing lever for a "G#", note in relation to a center in width of the rear portion of the corresponding white key so that one of said vertical reinforcement ribs is disposed in a space between said swing levers for a "F#" note and the "G" note.

* * * * *